United States Patent [19]

Wellard

[11] 4,174,513

[45] Nov. 13, 1979

[54] FOIL TYPE RESISTOR WITH FIRMLY FIXED LEAD WIRES

[75] Inventor: Charles L. Wellard, Oaks, Pa.

[73] Assignee: American Components Inc., Conshohocken, Pa.

[21] Appl. No.: 893,286

[22] Filed: Apr. 5, 1978

[51] Int. Cl.[2] ..... H01C 1/012

[52] U.S. Cl. ..... 338/312; 174/97; 338/295; 338/314; 338/320; 338/323; 338/329

[58] Field of Search ..... 338/312, 314, 320, 295, 338/329, 306–309, 315, 322–324, 333, 334; 174/96, 97, 68.5

[56] References Cited

U.S. PATENT DOCUMENTS 3,277,232 10/1966 Ragan ..... 338/312 X

*Primary Examiner*—C. L. Albritton

*Attorney, Agent, or Firm*—William E. Cleaver

[57] ABSTRACT

In the present device, a base member is included which has channels formed therein to hold lead wires. In the preferred embodiment a metal foil resistor member, having termination land sections, is secured to the base member to form a fourth side for each channel, thereby securely locating the lead wires in the channels and the lead wires are firmly connected to the termination land sections of the foil resistor. Accordingly with respect to the foil resistor assembly: there is good physical strength to withstand external forces; the resistor reliability is enhanced; the fabrication is simplified; and the resistance range capability is increased.

7 Claims, 7 Drawing Figures

FOIL TYPE RESISTOR WITH FIRMLY FIXED LEAD WIRES

BACKGROUND

In the prior art a metal foil resistor usually consists of a thin layer of low temperature coefficient metal, such as nickelchromium. The thin layer of metal is normally formed into a zig-zag path, or a meandering path, and is secured to a substrate of glass or ceramic. The zig-zag pattern is usually photo-etched onto the substrate and the pattern includes two relatively large areas, known as termination lands, which provide a means to which an electrical circuit to the resistor can be attached. It is common practice to effect a connection between a termination land and a lead wire by welding thin pieces of highly conductive metal, such as copper in the form of ribbons, between each termination land and its associated lead wire. As can be readily understood, the connections made to the resistor in accordance with the foregoing procedure represent a somewhat fragile arrangement. In order to accomplish the fabrication of the resistor package (which includes adjusting the resistor value by removing trimming bars), it has been the past practice to use expensive jig devices or fixtures: while connecting the ribbons to the lead wires; while removing the trimming bars between the loops of the zig-zag paths to alter the resistance value; and while holding the lead wires folded under the base of the metal foil assembly member so that the overall assembly, including the lead wires and ribbons, is encapsulated in a potting material such as epoxy. As can be readily understood, the foregoing procedure represents a problem in handling and there is a high percentage of breakage during the production operation. In the prior art it has been found that a foil resistor of the kind described may successfully pass its assembly test but under stress, i.e. in its actual use, it fails, particularly at the ribbon connecting positions. Such failures have caused such resistors to be identified with a significant degree of unreliability. The present invention simplifies the fabrication technique, eliminates the need for expensive jigs and fixtures, and provides for the production of reliable resistors.

SUMMARY

In the present device there is a preformed base member having three sided channels formed therein. Into each channel there is located a lead wire. In the preferred embodiment the lead wire is a nail head wire. Over the base member there is located a substrate member with a metal foil resistor formed thereon. The substrate member acts similarly to a lid, i.e. it closes up the channels on the upper side, to secure the lead wires. In the preferred embodiment the substrate member is secured to the channelled base member by an epoxy glue or bonding material. Actually in the preferred embodiment the sides of the channels are formed at an angle to the base so that the lead wires can in effect be wedged into the channels. The pattern of the metal foil resistor provides two termination land areas and these termination lands become disposed in close proximity to the ends of the lead wires when the substrate member is secured to the channelled base member. Thereafter wires, or metal ribbons, are connected between the lead wire ends and the termination lands. This final connection arrangement has a number of advantages over the prior art such as: ease of fabrication, greater physical strength to resist external forces; improved resistance range capability; and the capacity of being able to mount a variety of resistor chips on a common base structure.

The objects and features of the present invention will be better understood from the following description taken in conjunction with the figures in which.

Figure 1:
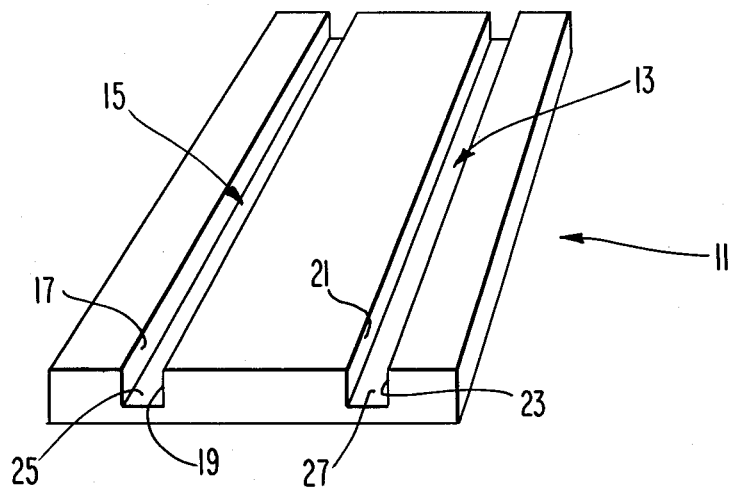
FIG. 1 is a pictorial view of the member with channels formed therein.

Consider FIG. 1 wherein there is shown a pictorial view of a common base member 11. The common base member 11, in the preferred embodiment, is made from a ceramic such as alumina. Other ceramics could be used or the base could be made from glass. The common base member 11 has two channels 13 and 15 formed therein. The channels 13 and 15 can be formed by having the base member 11 molded, or by cutting the channels 13 and 15 into a base member. In the preferred embodiment the base member 11 is molded and the side walls 17, 19, 21 and 23 are tapered angularly, respectively, away from the base sides 25 and 27 thus forming a wedge like channel.

Figure 2:
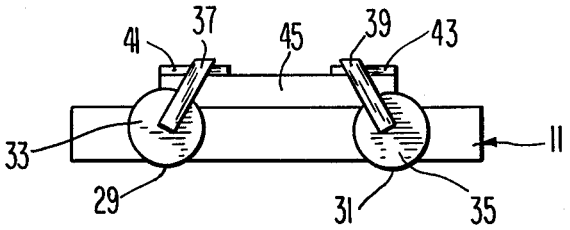
FIG. 2 is an end view of the resistor assembly wherein the resistor chip is relatively small compared to the size of the common base member.

Examine FIG. 2 which shows the lead wires 29 and 31 respectively with nail head ends 33 and 35 located in the base member 11. In the preferred embodiment the lead wires are nail head wires but a lead wire with an "L" shaped end or a lead wire whose end has no particular shape could be used. The nail head lead wire does have the advantage that when it is fitted into the channel it locks itself against the end of the base member. In addition the nail head lead wire provides a relatively large area (such as the stamped end 33) onto which a ribbon wire can be secured.

Figure 3:
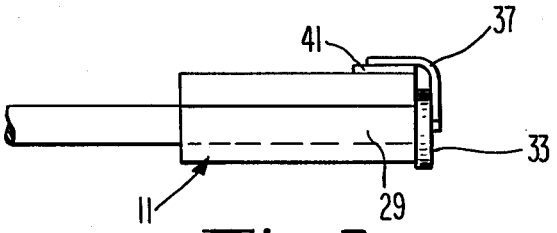
FIG. 3 is a side view of the assembly shown in FIG. 2.
Figure 4:
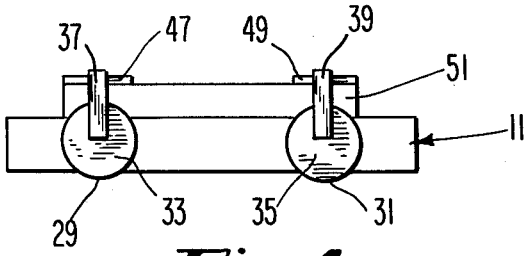
FIG. 4 is an end view of a resistor assembly wherein the resistor chip is larger than that shown in FIG. 2.
Figure 5:
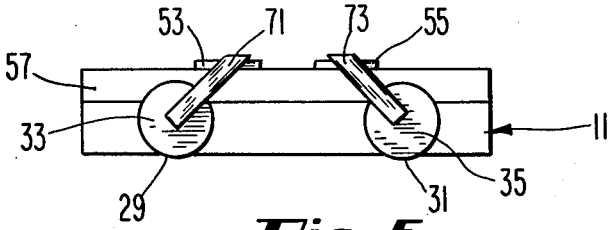
FIG. 5 is an end view of a resistor assembly wherein the resistor chip is as large as the common base member.

FIG. 3 shows a side view of the resistor assembly shown in FIG. 2. As can be seen in FIG. 3 the ribbon wire 37 is welded to the stamped end 33 of the nail end lead 29 and the termination land 41. From FIG. 2 it can be gleaned that the ribbon connections 37 and 39 are made between the stamped end 33 and 35 and two termination lands 41 and 43. Note in FIG. 2 that the resistor chip 45 is not as large as the common base member 11. If the utilization of the resistor requires a particular resistance value, the proper valued resistor chip is chosen to be secured to the common base. Note that the resistor chips shown in FIGS. 2, 4 and 5 differ in size but are all mounted on a similar base member 11. In FIG. 5 the ribbon wires 71 and 73 are shown connected between the termination lands 53 and 55 and the nail head ends 33 and 35.

Irrespective of what the resistance path might be, or where on the end of the chip the termination lands might be, the present device permits an easy connection between the lead wire ends and the termination lands of the resistor chip.

Figure 7:
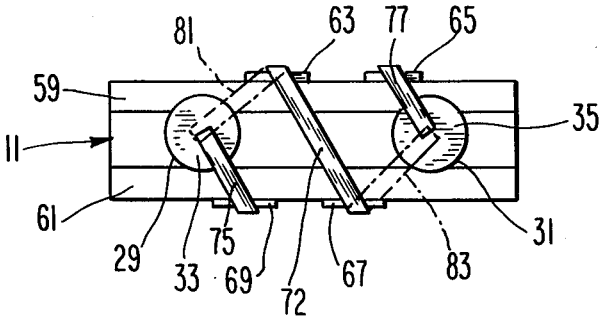
FIG. 7 is a side view of the device shown in FIG. 6.

FIG. 7 shows the present invention with a resistor chip mounted on each side of the base 11. By having a resistor chip mounted on both sides of the common base member, additional resistance can be added to a resistor package without substantially increasing the size of the package. The resistor assembly shown in FIG. 7 has a resistance path on chip 59 and a resistance path on chip 61. The land areas 63 and 65 as well as land areas 67 and 69 are located so that they can readily be connected to the nail head ends 33 and 35. The ribbon 72 causes the resistance paths of chips 59 and 61 to be connected in a serial fashion. If the utilization requires that the resistance paths be in parallel then nail head 35 could be connected to the land areas 65 and 67, while the nail head 33 could be connected to land areas 63 and 69.

In the prior art, the ribbon connections are secured to a large section of the termination land because the forces on the ribbons when the assembly was being fabricated are substantial. With the present invention a ribbon wire is simply fitted over the end, see FIG. 3, and readily welded to the termination land and the nail head wires end. There no longer is a need to place the lead wires in a jig to be held until the ribbons are connected to the termination lands and the termination lands can be made smaller.

Figure 6:
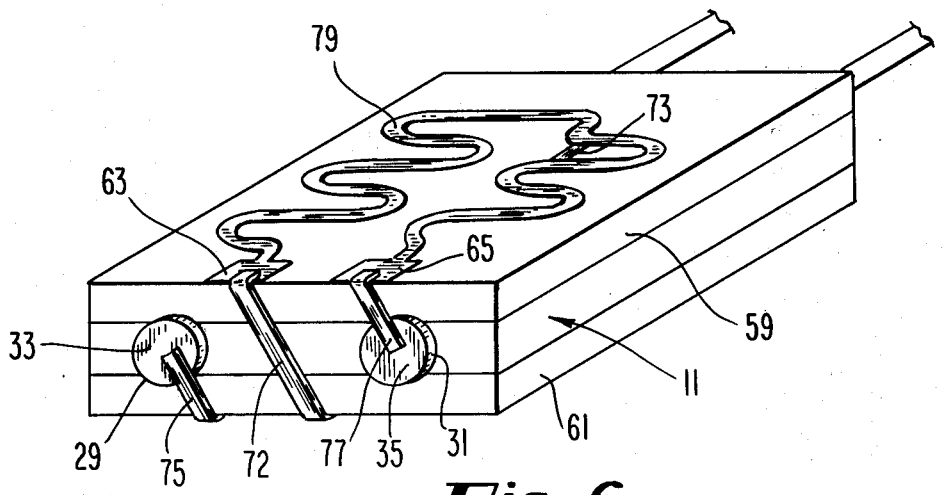
FIG. 6 is a pictorial view of a resistor assembly having a resistor on two sides of the common base member.

FIG. 6 shows a pictorial of the device shown in FIG. 7. In FIG. 6 the meandoring path of the resistance material is shown on the resistors chip 59. One of the trimming bars 73 is shown as not being removed. If the trimming bar remains in the circuit the resistance path will be shorted out at the trimming bar position. If more resistance is required in the path, the trimming bar is removed. As can be gleaned from FIG. 6 the ribbons 72, 75 and 77 can be readily welded to the termination lands 63 and 65 as well as to the nail head ends 33 and 35.

As mentioned earlier no jigs or fixtures are required to hold the lead wires to effect an easy connection to the termination lands. The lead wires are already held firmly in the channels. It is a simple matter to secure a chip assembly by an epoxy glue, or the like, to the base member 11 and then weld the ribbons to the termination lands and to the nail head ends. If there is not a sufficient amount of resistance provided by the meandoring path 79 then a second resistor chip 61 can be added to the other side package and its meandoring path can be connected in series to the meandoring path 79 thereby increasing the resistance value.

It has been determined that by welding the ribbons as shown in FIG. 6 the package can withstand great physical stresses compared to the prior art foil resistor packages. The resistance value can be altered by using the proper resistor chip and irrespective of the resistor chip used, it can be fitted over the common base to take advantage of the common channelled base member. The ribbons can be welded with an electrical welding device or by ultrasonically welding or the like.

After the package is connected as shown in FIGS. 2, 3, 4, 5, 6 and 7 the entire assembly is encapsulated in an epoxy to reduce the effects of the surrounding atmosphere and to protect the resistor from physical damage. In the prior art metal foil resistors there was often damage done when the epoxy came in contact with the fragile connection holding the ribbon to the termination land. With the present invention, the land areas can be reduced in size which provides for resistance values of greater magnitude. The present resistor assembly is a ruggedized component and since the external forces cannot readily open the electrical connections, the present resistor assembly has a high degree of reliability.

In FIG. 7 there are shown two connecting wires 81 and 83 in phantom. If the resistor assembly were to be used in a manner that it would be necessary for the resistor chip 59 to be connected in parallel to the resistor chip 61, then the ribbon connection would be as shown in phantom and ribbon 72 would not be employed.

What I claim is:

1. A metal foil type resistor assembly comprising in combination: a base means having channels formed therein, said channels opening to a first side of said base means, lead wires disposed in said channels and formed to be accessible for making electrical connections thereto; a first substrate means having an upper side and a lower side and having a metal configuration secured to its upper side, said metal configuration formed to have at least two termination lands and formed to provide electrical resistance, said first substrate means secured at its lower side to said first side of said base means; connecting wire means connecting each of said lead wires with an associated termination land.

2. A metal foil type resistor assembly according to claim 1 wherein said lead wires are nail head wires.

3. A metal foil type resistor assembly according to claim 1 wherein each of said connecting wire means is a thin copper ribbon type wire.

4. A metal foil type resistor assembly according to claim 1 wherein there is further included a second substrate having an upper side and a lower side and having a metal configuration secured to its lower side, said metal configuration formed to have at least two termination lands and formed to provide electrical resistance, said second substrate means secured at its upper side to a second side of said base means; and including further connecting wire means connected between a termination land of the metal configuration on said first substrate and a termination land of the metal configuration on said second substrate and wherein at least one of the associated termination lands connected to a lead wire is termination land located on said second substrate.

5. A metal foil type resistor assembly according to claim 1 wherein said metal configuration of said first substrate means is composed of a thin metal foil.

6. A metal foil type resistor assembly according to claim 1 wherein there is further included a second substrate having an upper side and a lower side and having a metal configuration secured to its lower side, said metal configuration formed to have at least two termination lands and formed to provide electrical resistance, said second substrate means secured at its upper side to a second side of said base means; and wherein some of said connecting wire means are connected between a lead wire and a termination land located on said first substrate as well as to a termination land located on said second substrate and some other of said connecting wire means are connected between another lead wire and another termination land located on said first substrate as well as to another termination land located on said second substrate.

7. A metal foil type resistor assembly according to claim 1 wherein each of said channels has side walls and a lower wall and wherein each of said side walls is tapered angularly from said lower wall so that each of said lead wires can be wedged into its associated channel.

* * * * *